US006151718A

United States Patent [19]

Shirai

[11] Patent Number: 6,151,718

[45] Date of Patent: Nov. 28, 2000

[54] SAFETY CAP

[75] Inventor: Syoji Shirai, Kawasaki, Japan

[73] Assignee: Builmatel Co., Ltd., Tokyo, Japan

[21] Appl. No.: 09/308,886

[22] PCT Filed: Nov. 26, 1997

[86] PCT No.: PCT/JP97/04303

§ 371 Date: May 24, 1999

§ 102(e) Date: May 24, 1999

[87] PCT Pub. No.: WO98/23176

PCT Pub. Date: Jun. 4, 1998

[51] Int. Cl.[7] ..... A42B 3/28

[52] U.S. Cl. ..... 2/410; 2/171.3; 2/184.5; 2/DIG. 5

[58] Field of Search ..... 2/410, 411, 171.3, 2/DIG. 5, 182.8, 184.5, 209.5, 209.7, 175.6

[56] References Cited

U.S. PATENT DOCUMENTS

| | | | |
|---|---|---|---|
| 1,170,052 | 2/1916 | Diener et al. . | |
| 1,991,829 | 2/1935 | Uriwal | 2/193 |
| 3,026,522 | 3/1962 | Di Julio | 2/2.1 |
| 5,533,500 | 7/1996 | Her-Mou | 128/201.25 |
| 5,819,318 | 10/1998 | Tse | 2/182.1 |
| 5,937,446 | 8/1999 | Fallert | 2/412 |
| 5,940,889 | 8/1999 | Shirai | 2/411 |

*Primary Examiner*—Michael A. Neas
*Attorney, Agent, or Firm*—Kanesaka & Takeuchi

[57] ABSTRACT

It is an object to provide a safety cap which is lightweight and excellent in air ventilating ability and waterproofness in rainy weather or the like. The safety cap includes an air hole penetrating inner and outer walls of a cap body, a drainage channel provided along the inner wall of the cap body for discharging water coming into the cap body through the air hole to outside of the cap body, and a vent hole in an upper side of a cross section of the drainage channel perpendicular to the drainage direction. Alternatively the safety cap includes a drainage groove formed in the outer surface of a cap body and having a plurality of vent holes formed in the side walls thereof, wherein the drainage groove is covered with a cover body having air holes and also an edge section of the drainage groove is opened to an outside of the cap body as a drainage hole. And the safety cap is provided with a recessed portion on a surface of the cap body, wherein the recessed portion has vent holes respectively penetrating the the inner and outer walls thereof, and the recessed portion is covered with a cover body having air holes and drainage holes provided at positions where the holes do not overlap the vent holes.

8 Claims, 3 Drawing Sheets

SAFETY CAP

FIELD OF THE INVENTION

The present invention relates to a structure of a safety cap worn for protection of a head in construction works, engineering works, and other works.

BACKGROUND TECHNOLOGY

At various working sites or plants, a worker wears a safety cap on the worker's head for protection against a flying or dropping object or against injuries when the worker falls from a high portion. But if the safety cap is worn for a long time especially in summer or during a work with hard physical labor, the worker's head is heated with moisture by perspiration. As a result, it becomes uncomfortable to the worker, and in addition the work efficiency becomes lower.

To provide a safety cap with air ventilating ability, there has been disclosed a safety cap made from a net or a meshed and porous material formed into a multi-layered structure with void portions arranged alternately in Japanese Utility Model Laid-Open Publication No.143736/1985. Also the model described in Japanese Utility Model Laid-Open Publication No.7832/1983 has a feature to provide a safety cap with air ventilating ability, and further Japanese Utility Model Laid-Open Publication No.94430/1989 discloses an air ventilating device to be set inside a safety and protective tool, such as a working helmet, a vehicle helmet, safety shoes or the like.

However, these safety caps do not have a waterproof feature in rainy weather when worn outdoors.

Japanese Utility Model Publication No.20108/1967 discloses a helmet having air ventilating ability and a waterproof feature in rainy weather, but in this model, small holes are provided in a side section of a cap body, so that a flying or dropping object may come into an inside of the cap body through the hole and also the strength is not sufficient, and for the reasons the model can not achieve the essential object of a helmet to protect a wearer's head. Further, when a worker wearing the cap works in a slouching posture, rain water comes into the helmet, so that the helmet can not be worn in rainy weather.

Before, the inventor of the present invention proposed a safety cap comprising a dual structural cap body as a safety cap having air ventilating ability and waterproofness in International Publication No. W095/28101. However, the safety cap can not avoid the increase of weight as a result of the dual structure.

DISCLOSURE OF THE INVENTION

It is an object of the present invention to provide a safety cap which is lightweight and excellent in air ventilating ability and waterproofness in rainy weather or the like.

The safety cap according to the present invention comprises an air hole penetrating inner and outer walls of a cap body, a drainage channel provided along the inner wall of the cap body for discharging water coming into an inside of the cap body through the air hole to an outside of the cap body, and a vent hole in an upper side of the drainage channel perpendicular to the drainage direction. Preferably, a drainage hole of the drainage channel is opened in an outer surface of the cap body. Further preferably the shape of a cross section of the drainage channel perpendicular to the drainage direction is U-shaped.

Also, the safety cap according to the present invention comprises a drainage groove formed in the outer surface of a cap body and having a plurality of vent holes formed in the side walls thereof, wherein the drainage groove is covered with a cover body having air holes and also an edge section of the drainage channel groove is opened to outside of the cap body as a drainage hole. Preferably, the vent holes in the side walls and the air holes in the cover body are provided so that the holes do not overlap at the location of the drainage direction.

Also, the safety cap according to the present invention is provided with a recessed portion on a surface of the cap body, wherein the recessed portion has vent holes respectively penetrating the inner and outer walls thereof, and the recessed portion is covered with a cover body having air holes and drainage holes provided at positions where the holes do not overlap the vent holes. Preferably, the air hole and drainage hole are formed of one hole functioning as both of the air hole and drainage hole. And preferably, the recessed portion has a dish-shaped form and a shape of the recessed portion when viewed from the front side is substantially circular. Further preferably, the recessed portion is formed as a peripheral groove on the surface of the cap body.

BRIEF DESCRIPTIONS OF THE DRAWINGS

Figure 3A:
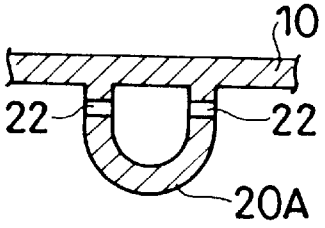
Figure 3B:
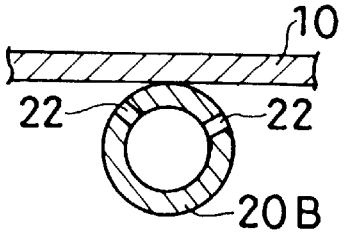
Figure 4:
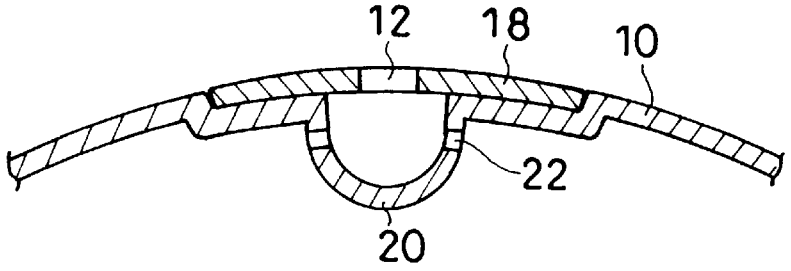
Figure 5A:
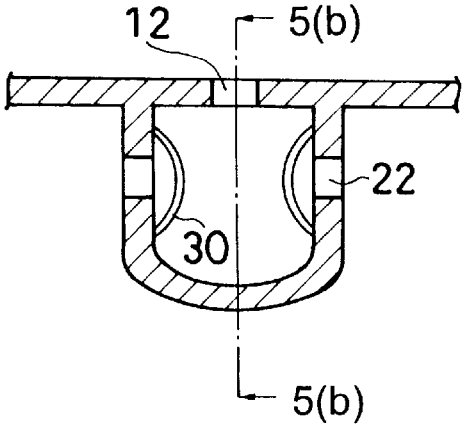
Figure 5B:
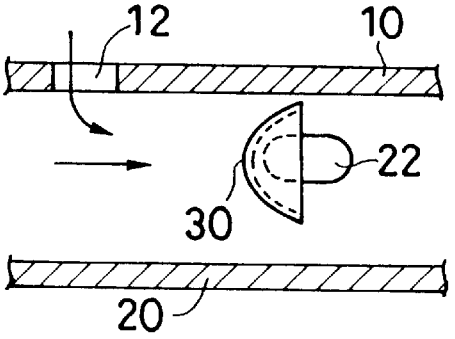
Figure 6A:
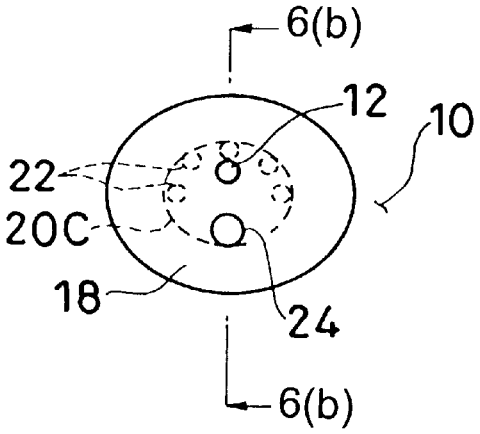
Figure 6B:
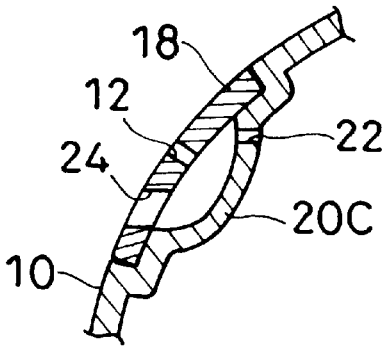
Figure 7A:
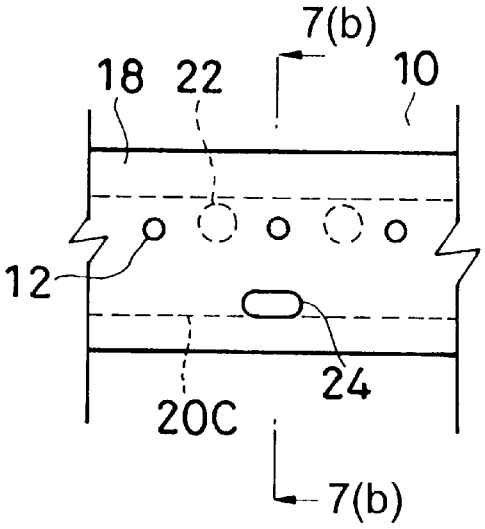
Figure 7B:
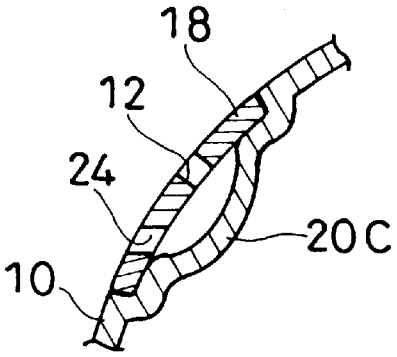

FIGS. 3(*a*) and 3(*b*) are sectional cross sectional views of a drainage channel 20; wherein FIG. 3(*a*) shows the drainage channel having a U-shaped cross section, and FIG. 3(*b*) shows that having a round cross section;

FIG. 4 is a partial vertical cross sectional view of the safety cap according; another embodiment of the present invention;

FIG. 5(*a*) is a partial vertical cross sectional view of the drainage channel according to another embodiment of the present invention;

FIG. 5(*b*) is a side view taken along line 5(*b*)–5(*b*) in FIG. 5(*a*);

FIGS. 6(*a*) and 6(*b*) show another variant of the safety cap shown in FIG. 4, wherein FIG. 6(*a*) is a partial side view showing the same, and FIG. 6(*b*) is a partial vertical cross sectional view taken along line 6(*b*)—6(*b*) of FIG. 6(*a*); and FIGS. 7(*a*) and 7(*b*) show still another variant of the safety cap shown in FIG. 4, wherein FIG. 7(*a*) is a partial side view showing the same and FIG. 7(*b*) is a partial vertical cross sectional view taken along line 7(*b*)—7(*b*) show still.

BEST MODE FOR CARRYING OUT THE INVENTION

Detailed description is made hereinafter for the safety cap according to the present invention with reference to the related drawings.

Figure 1:
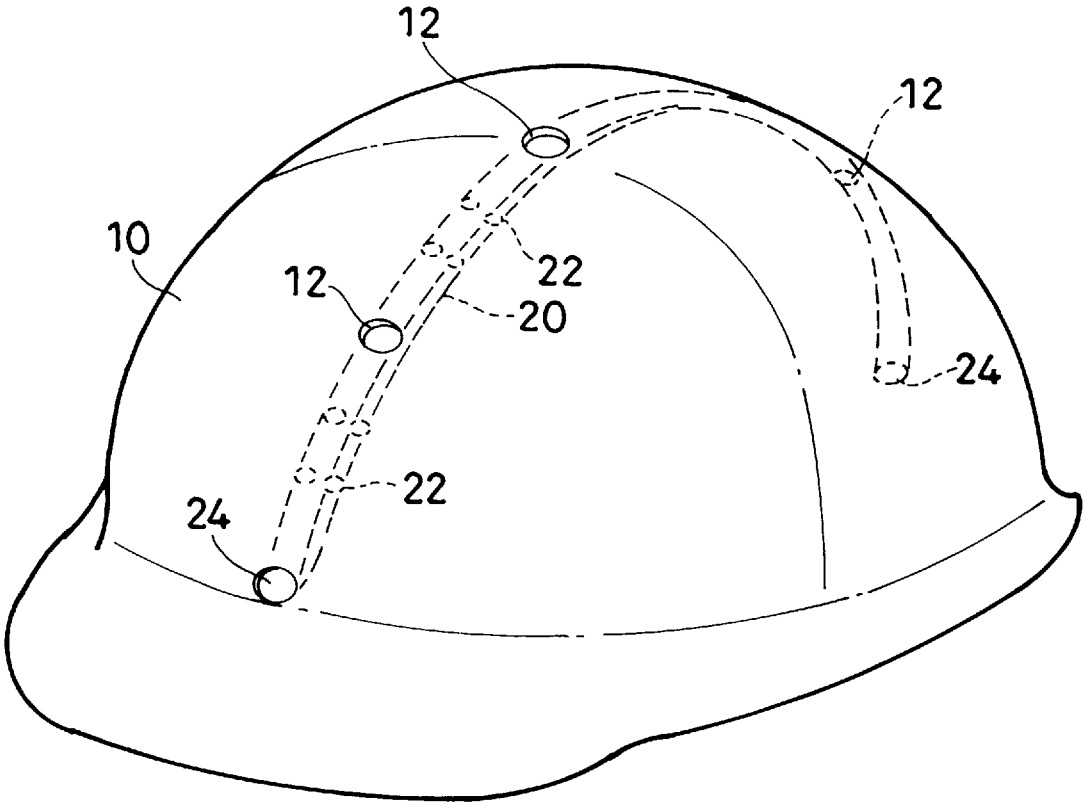
FIG. 1 is a perspective view showing a cap body constituting a main body of the safety cap according to the present invention.

FIG. 1 is a perspective view showing a safety cap constituting a main body of the safety cap. In this figure, a chin-strap usually prepared for preventing the safety cap from dropping off, and the so-called attachment or a shock-absorbing liner set inside the cap body 10 are not shown herein.

As a material for the cap body 10, synthetic resin, such as polyester, polypropylene, polyethylene, polycarbonate, and ABS resin, may be used. When strength is important, iron, steel, aluminum, aluminum alloy, or other high strength alloys can be used, and such materials as fiber reinforced plastics and ceramics may be used according to specific applications of the safety cap.

A plurality of air holes 12 are provided in the cap body 10, and each hole 12 is formed to penetrate inner and outer walls of the cap body 10. The air holes 12 is formed so that the external air is introduced into the interior of the cap body 10 therethrough, and locations of the air holes are not specifically limited. There is not any specific limitation concerning a size of the air hole 12, and the size is enough if it is approximately large enough for maintaining the strength of the cap body 10. A number of air holes 12 should preferably be in a range from several to tens. A shape of the air hole 12 is not necessarily limited to the circular one as shown in the figure, and the shape may be oval or polygonal.

Figure 2:
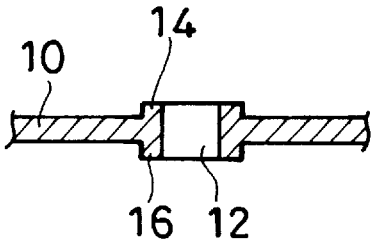
FIG. 2 is a vertical cross sectional view of an air hole 12.

Around the air holes 12, as shown in FIG. 2 showing a vertical cross section of the air hole 12, a bank 14 for preventing rain water from coming into an inside of the cap body 10 may be provided on the outer wall of the cap body 10, and a reinforcing ring 16 may be provided in the projecting form on the inner wall of the cap body 10.

The reference numeral 20 indicates a drainage channel formed along the inner wall of the cap body 10 for playing a role of discharging rain water entering the interior of the cap body 10 through the air holes 12 to outside of the cap body 10. To achieve this object, in this embodiment, the drainage channel 20 is arranged so that the drainage channel opposes to the air holes 12. In other words, in FIG. 1, a plurality of the air holes 12 is formed, in a central section of the cap body 10 along the front-to-rear thereof, and the drainage channel 20 is arranged at a position where the drainage channel 20 communicates the air holes 12 with each other.

As described above, the drainage channel 20 is arranged in correspondence to positions of the air holes 12, but layout of the drainage channel 20 is not specifically limited. The drainage channel 20 may be provided along the front-to-rear direction of the cap body 10 as shown in FIG. 1, or two drainage channels may be provided so that the drainage channels cross each other at right angle and the top view is a cross as indicated by a dot and dash lines in FIG. 1. When the air holes 12 are not provided at a vertex section of the cap body 10, the drainage channel 20 may be provided in a side section of the cap body 10, and further a plurality of drainage channels 20 may be provided in parallel to each other along the front-to-rear direction of the cap body 10.

A shape of the drainage channel 20 is not limited to a straight one, and may possibly be curving or helical along the tilted surface of the inner wall of the cap body 10.

The drainage channel 20 may be, for instance, a drainage groove 20A having a U-shaped cross section (as shown in FIG. 3(*a*)), or a drainage tube 20B having a circular cross section (as shown in FIG. 3(*b*)). When the drainage groove 20A is employed, strength of the cap body 10 around the air holes 12 can be increased.

When the drainage tube 20B as shown in FIG. 3(*b*) is employed, by using, in addition to the same material as that for the cap body 10, other materials, such as polyvinylchloride, polyethylene terephthalate, and other flexible and light weight synthetic resins, natural rubber, synthetic rubber or the like, the drainage channel 20 can be manufactured as a separate body from the cap body 10. Furthermore, in this case, it is possible to provide the air holes 12 and attach the drainage tube 20B to a normal type of safety cap, in which no measures are taken for ventilation or against rain water, later.

The drainage tube 20B is attached to the inner wall of the cap body 10, if necessary by using a fitting tool or the like, not shown in the figure. The drainage tube 20B may detachably be attached thereto.

As shown in FIGS. 3(*a*) and 3(*b*), a plurality of the vent holes 22 is formed in a side wall of the drainage groove 20A or in an upper section of the drainage tube 20B. Locations of the vent holes 22 are arranged so that at the draining direction the vent holes 22 would not overlap the air holes 12 for the purpose to prevent rain water entering the air holes 12 from coming into the inside of the cap body 10 through the vent holes 22.

Size and shape of the vent hole 22 are the same as those of the air hole 12.

An edge of the drainage channel 20 opens to the outside of the cap body 10 as a drainage hole 24. In this embedment, the drainage bole 24 having substantially the same size as that of the air hole 12 opens on the outer wall of the cap body 10 at a central portion in the front-to-rear direction thereof. It should be noted that the drainage channel 20 may extend as it is with the drainage hole 24 provided at an edge of the drainage groove 20A or the drainage tube 20B in a tangent inner peripheral section of the cap body 10.

In the present invention, the inside and outside of the cap body 10 communicate with each other through the air holes 12, the drainage channel 20, and the vent holes 22, so that external air can freely come into or go out from the inside of the cap body 10. In this way, the drainage channel 20 not only drains rain water, but also functions as a flow path for air.

Sometimes, not only rain water, but also something dropped or flying may enter inside of the cap body 10 through the air holes 12, but the drainage channel 20 also functions as a protection plate, thus the matter being prevented from directly entering inside of the cap body 10.

When the safety cap according to the present invention is used outdoors in rainy weather or the like, rain water comes into the drainage channel 20 through the air holes 12 of the safety cap, flows down along the inclination of the drainage channel 20, and then discharged out of the drainage hole 24. Though the safety cap worn on the worker's head is apt to incline frequently, rain water never comes into the inside of the cap body 10 through the vent holes 22 provided on the side wall of the drainage channel 20, since the vent holes 22 are located at the upper portion.

Next description is made for another embodiment of the safety cap according to the present invention with reference to FIG. 4.

FIG. 4 is a partial side view showing a cross section of the drainage channel 20 cut with a plain perpendicular to the drainage direction. In this embodiment, the cap body 10 is divided to two structural members, which are integrated with each other easily by supersonic welding or some other appropriate means namely the drainage channel is formed on an outer surface of the cap body 10 and also the drainage channel add covered with a cover body 18. In the cover body 18, a plurality of air holes 12 is formed at the positions opposite to the drainage channel 20 for the same purpose as that described in the above embodiment. As described above, it is preferable to provide the air holes 12 and the vent holes 22 so that both holes do not overlap at the locations of the drainage directions.

When the safety cap according to the present invention is used for a rider of an automatic two-wheeled vehicle, it is necessary to take strict measures for waterproofness in rainy weather. This is required because rain water in the drainage channel 20 enters the interior of the cap body 10 through the vent holes 22 with a high-speed airflow generated during running of the automatic two-wheeled vehicle. It is necessary for waterproofness that the air holes 12, drainage holes 24 and the drainage channel 20 are located at the most suited positions.

FIG. 5(*a*) is a partial vertical cross section of the drainage channel 20 according to another embodiment of the present invention, and FIG. 5(*b*) is a side view taken along line 5(*b*)—5(*b*) in FIG. 5(*a*). In this embodiment, windshield plates 30 are provided in front of the vent holes 22 (in the upstream side from the airflow) so that the high speed airflow goes along the outer side the plates. As a result, the rainwater accompanied by the high-speed airflow is prevented from flowing through the vent holes 22.

Next description is made for other embodiments of the safety cap according to the present invention with reference to FIG. 6(*a*) through FIG. 7(*b*).

These embodiments are variants of the embodiment shown in FIG. 4, and FIG. 6(*a*) and FIG. 7(*a*) are partial side views of cover bodies is seen from the side of a cap body, and FIG. 6(*b*) and FIG. 7(*b*) are side views taken along line 6(*b*)—6(*b*) in FIG. 6(*a*) and line 7(*b*)—7(*b*) in FIG. 7(*a*), respectively. It should be noted that the same reference numerals are assigned to the same components as those in FIG. 4, and descriptions thereof are omitted herein.

The cover body 18 is attached to the cap body 10 so that the cover body 18 covers a recessed portion 20C formed in an outer surface of the cap body 10. A shape of the recessed portion 20C is like a dish in FIGS. 6(*a*) and 6(*b*), and its shape viewed from the front side is circular. On the other hand, in FIGS. 7(*a*) and 7(*b* ), a circular groove is formed in the outer surface of the cap body 10. When the recessed portion 20C is provided as the dish as shown in FIG. 6, the number may be in a range from several to tens, and when the recessed portion 20C is provided as the groove as shown in FIGS. 7(*a*) and 7(*b*), one or two grooves are enough to fulfill the purpose. Accordingly, a form and a number of the cover body 18 changes according to the recessed portion 20C. The cover body 18 may be joined to or engaged with the safety cap according to the necessity.

The air hole 12 and the drainage hole 24 provided in the cover body 18 may be arranged discretely or as a hole functioning as the two types of hole described above. As the position of drainage hole 24 is lower than that of the air hole 12, when the air hole 12 and drainage hole 24 are provided discretely, as warm air inside the cap body 10 is discharged through the air hole 12, the air ventability ability becomes higher. On the other hand, when one hole functions as both the air hole 12 and drainage hole 24, a safety cap excellent in waterproofness can be obtained, because there are no air holes 12 in an upper section thereof.

In the penetration resistance test and shock absorbing test both required by Minister of Labor in Japan (Labor Ministry Notification No.39, Jun. 5, 1991, the former test stipulated in Articles 6 and 7, and the latter in Article 8), the certification of performances specified in the Articles was acquired for the safety cap.

APPLICABILITY FOR INDUSTRIAL PURPOSES

The safety cap according to the present invention is lightweight and excellent in the air ventilating ability and waterproofness in rainy weather or the like. Also, it is safety as a protective cap because of the high strength structure.

For the reasons as described above, the safety cap according to the present invention can be used in various construction works, in operating a heavy construction machine, in driving a vehicle or an airplane, in guarding works inside or outside a building, in works by policemen or firemen, and further in playing American football, ice hockey, and other types of sports. Also, the safety cap can be worn at a site of construction works for a building, a dam, or the like, at a site for construction of a road, tunnel, or the like, or at a work shop in a ship mill, an iron foundry, ironworks, at a mining site, and at various working sites or plants.

What is claimed is:

1. A safety cap comprising:

a cap body;

an air hole penetrating inner and outer walls of the cap body;

a drainage channel provided along the inner wall of the cap body for discharging water coming into an inside of the cap body through the air hole to an outside of the cap body, said drainage channel having a drainage hole opened in an outer surface of the cap body; and a vent hole in an upper side of the drainage channel in a cross section perpendicular to a drainage direction.

2. A safety cap according to claim 1; wherein a shape of a cross section of the drainage channel perpendicular to the drainage direction is U-shaped.

3. A safety cap comprising:

a cap body having a drainage groove formed in an outer surface of the cap body and a plurality of vent holes formed in side walls thereof, wherein the drainage groove is covered with a cover body having air holes, and also an edge section of the drainage groove is opened to an outside of the cap body as a drainage hole.

4. A safety cap according to claim 3; wherein the vent holes in the side walls and the air holes in the cover body are provided so that holes do not overlap at a drainage direction.

5. A safety cap comprising a cap body having a recessed portion on a surface of the cap body; wherein the recessed portion has vent holes each provided therein and penetrating inner and outer walls thereof, and the recessed portion is covered with a cover body having air holes and drainage holes provided at positions where the holes do not overlap the vent holes.

6. A safety cap according to claim 5; wherein the air holes and drainage holes comprise one hole functioning as both the air hole and drainage hole.

7. A safety cap according to claim 5; wherein the recessed portion has a dish-shaped form and a shape of the recessed portion when viewed from a front side is substantially circular.

8. A safety cap according to claim 5; wherein the recessed portion is formed as a peripheral groove on the surface of the cap body.

* * * * *